US006234612B1

(12) United States Patent
Cornell et al.

(10) Patent No.: US 6,234,612 B1
(45) **Date of Patent: *May 22, 2001**

(54) INK JET PRINTING APPARATUS HAVING FIRST AND SECOND PRINT CARTRIDGES RECEIVING ENERGY PULSES FROM A COMMON DRIVE CIRCUIT

(75) Inventors: Robert Wilson Cornell; James Harold Powers, both of Lexington, KY (US)

(73) Assignee: Lexmark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/823,634

(22) Filed: Mar. 25, 1997

(51) Int. Cl.[7] ..... B41J 2/05
(52) U.S. Cl. ..... 347/62
(58) Field of Search ..... 347/57, 15, 43, 347/62, 58, 59

(56) References Cited

U.S. PATENT DOCUMENTS

| | | | | |
|---|---|---|---|---|
| 4,675,693 | | 6/1987 | Yano et al. . | |
| 4,719,477 | * | 1/1988 | Hess | 347/59 |
| 4,789,425 | | 12/1988 | Drake et al. . | |
| 4,847,639 | | 7/1989 | Sugata et al. . | |
| 4,870,433 | | 9/1989 | Campbell et al. . | |
| 4,914,562 | | 4/1990 | Abe et al. . | |
| 4,931,813 | | 6/1990 | Pan et al. . | |
| 5,208,605 | | 5/1993 | Drake . | |
| 5,521,622 | * | 5/1996 | Hock et al. | 347/43 |
| 5,633,665 | * | 5/1997 | Komuro | 347/63 |
| 5,808,640 | * | 9/1998 | Bhaskar et al. | 347/58 |
| 5,867,183 | | 2/1999 | Cornell et al. | 347/13 |

FOREIGN PATENT DOCUMENTS

613781 * 2/1994 (EP) .

* cited by examiner

*Primary Examiner*—David F. Yockey
*Assistant Examiner*—Michael S. Brooke
(74) *Attorney, Agent, or Firm*—Michael T. Sanderson

(57) ABSTRACT

An ink jet printing apparatus is provided comprising first and second print cartridges. The first print cartridge includes at least one first resistive heating element in at least one first ink-containing chamber having a first orifice. The first heating element has a first surface area. The second print cartridge includes at least one second resistive heating element in at least one second ink-containing chamber having a second orifice. The second heating element has a second surface area which is less than the first surface area. The apparatus further comprises a driver circuit, electrically coupled to the first and second print cartridges, for selectively applying to one of the first and second heating elements via a common drive circuit a firing pulse. The firing pulse to the first heating element causing a vapor bubble to be produced in the first chamber such that a droplet of ink of a first size is ejected from the first chamber orifice. The firing pulse to the second heating element causing a vapor bubble to be produced in the second chamber such that a droplet of ink of a second size which is smaller than the first size is ejected from the second chamber orifice.

34 Claims, 4 Drawing Sheets

INK JET PRINTING APPARATUS HAVING FIRST AND SECOND PRINT CARTRIDGES RECEIVING ENERGY PULSES FROM A COMMON DRIVE CIRCUIT

FIELD OF THE INVENTION

This invention relates to ink jet printing apparatuses having first and second print cartridges which eject different size droplets. More particularly, it relates to such an apparatus having first and second print cartridges which are capable of being driven by a common drive circuit.

BACKGROUND OF THE INVENTION

Ink jet printing apparatuses having a first print cartridge for ejecting black droplets and a second print cartridge for ejecting cyan, magenta and yellow droplets are known in the art.

When hemispherical color droplets are placed side by side on a paper surface, an unintentional mixing may lead to a print defect known as "bleed." For example, a patch of yellow printed next to a patch of cyan would have a green stripe between them if ink bleed occurs. One of the solutions to bleed is to decrease the surface tension of the color inks such that rapid penetration into the paper occurs. This rapid penetration also causes the low surface tension color inks to produce larger spots than would be attained with an equivalently sized black ink droplet with less penetrating ability. This mismatch in spread factors requires that the color heating elements in the second print cartridge be much smaller than the black heating elements in the first print cartridge. The surface area of a heating element affects the size of the droplet produced when that heating element is fired.

The smaller color heating elements in the second print cartridge have the same square shape as the black heating elements in the first print cartridge. As sheet resistance is typically fixed for black and color heating elements, the resistance of the color heating elements is substantially the same as the resistance of the black heating elements.

It is generally desirable that the black and color heating elements, when fired, have substantially the same heating element energy density. If voltage pulses of substantially the same amplitude are provided to the color and black heating elements, the color heating elements must receive a much shorter firing pulse in order to keep energy density constant. Thus, a common set of drivers, i.e., a common drive circuit, which provides firing pulses of equal amplitude and duration, cannot be used to provide energy pulses to both the black and color heating elements.

In FIG. 1, heating element surface temperature-time curves are shown for a square black heating element and for a smaller, square color heating element. The superheat limit for a typical ink is shown by a dotted line. Also shown are firing pulse widths for firing pulses applied to the black and color heating elements. Because of variations in printer hardware and print cartridges, the heating elements are heated to temperatures beyond the superheat limit of the ink to ensure that ink nucleation occurs. As is apparent from these curves, the surface temperature of the smaller heating element increases at a much higher rate than that of the black heating element. This may be undesirable as it has been found that if a heating element is operated at temperatures at or above about 700° C., heating element resistivity may drift downward over time. As resistivity drifts downward, the heating element will draw even more current, leading to even higher heating element surface temperatures. Unpredictable changes in heating element resistivity are to be avoided if consistent performance is to be achieved.

Thus, it would be desirable to have an ink jet printing apparatus which uses a common drive circuit to provide energy pulses to both black and color heating elements. Further, it would be desirable to have color heating elements which, when fired, do not have surface temperatures exceeding about 700° C.

SUMMARY OF THE INVENTION

The instant invention is directed to an ink jet printing apparatus which uses a common drive circuit to provide energy pulses of constant amplitude and duration to both black and color heating elements included in first and second print cartridges, respectively. The color heating elements have a surface area which is less than that of the black heating elements. Hence, the second print cartridge ejects droplets which are smaller than those ejected by the first print cartridge. Further, the resistance of the color heating elements is greater than that of the black heating elements. As a result, the color heating elements absorb energy at a rate which is less than that of prior art square color heating elements having lower resistances. Preferably, the resistance of the color heating elements is selected such that the surface temperature-time curve for the color heating elements substantially follows that of the black heating elements.

DETAILED DESCRIPTION OF THE PREFERRED EMBODIMENT

Figure 1:
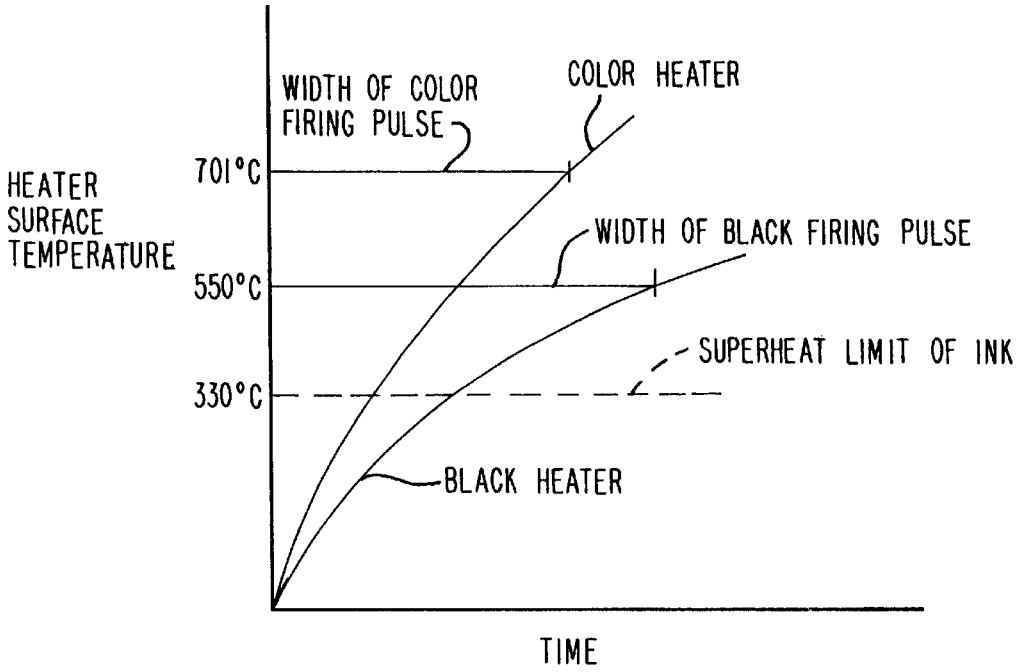
FIG. 1 PRIOR ART
FIG. 1 illustrates heating element surface temperature-time curves for prior art black and color heating elements.
Figure 2:
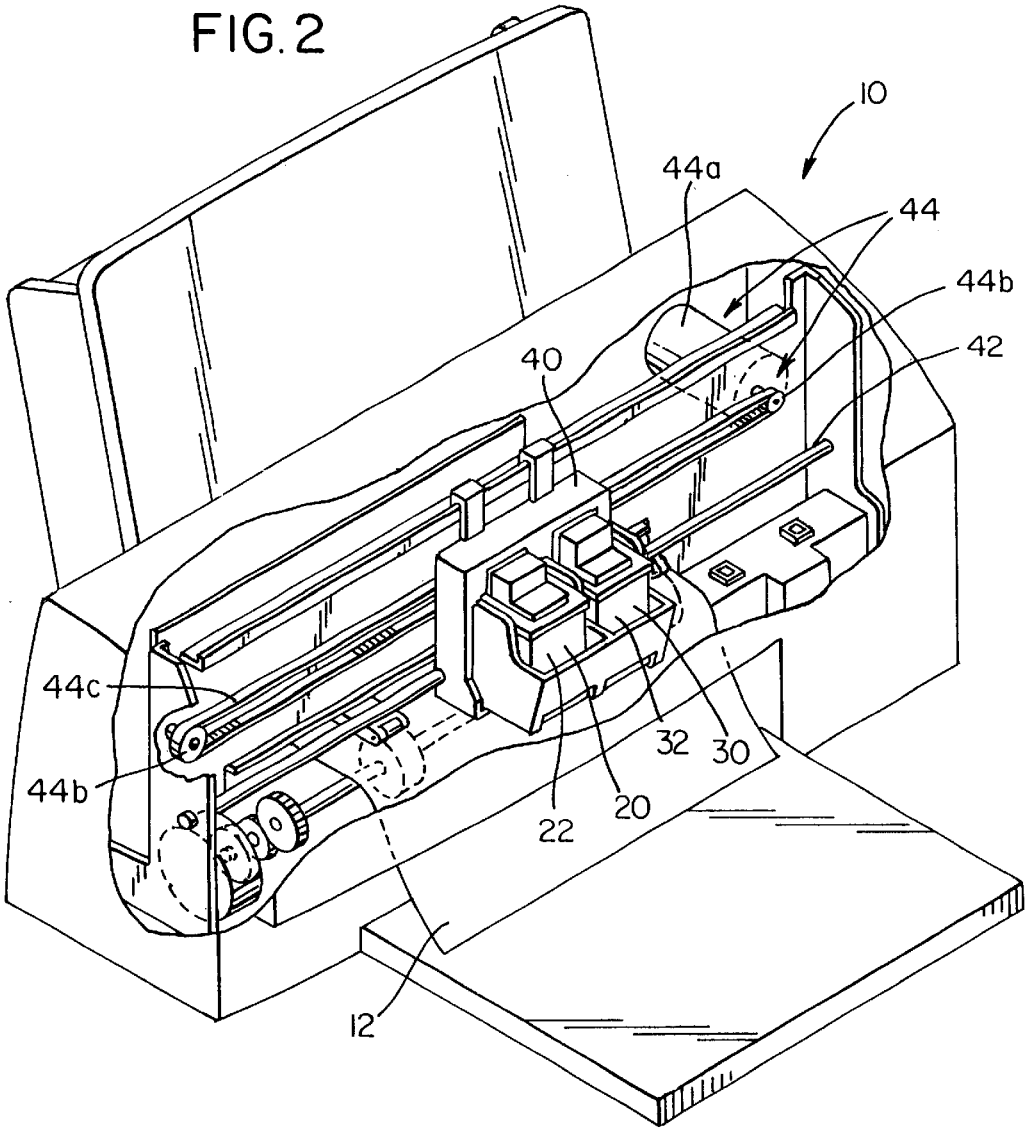
FIG. 2 is a perspective view, partially broken away, of a printing apparatus constructed in accordance with the present invention.

Referring now to FIG. 2, there is shown an ink jet printing apparatus 10 constructed in accordance with the present invention. It includes a first print cartridge 20 for ejecting first droplets and a second print cartridge 30 for ejecting second droplets. The cartridges 20 and 30 are supported in a carrier 40 which, in turn, is slidably supported on a guide rail 42. A drive mechanism 44 is provided for effecting reciprocating movement of the carrier 40 back and forth along the guide rail 42. The drive mechanism 44 includes a motor 44*a* with a drive pulley 44*b* and a drive belt 44*c* which extends about the drive pulley 44*b* and an idler pulley 44*d*. The carrier 40 is fixedly connected to the drive belt 44*c* so as to move with the drive belt 44*c*. Operation of the motor 44*a* effects back and forth movement of the drive belt 44*c* and, hence, back and forth movement of the carrier 40 and the print cartridges 20 and 30. As the print cartridges 20 and 30 move back and forth, they eject ink droplets onto a paper substrate 12 provided below them.

Figure 3:
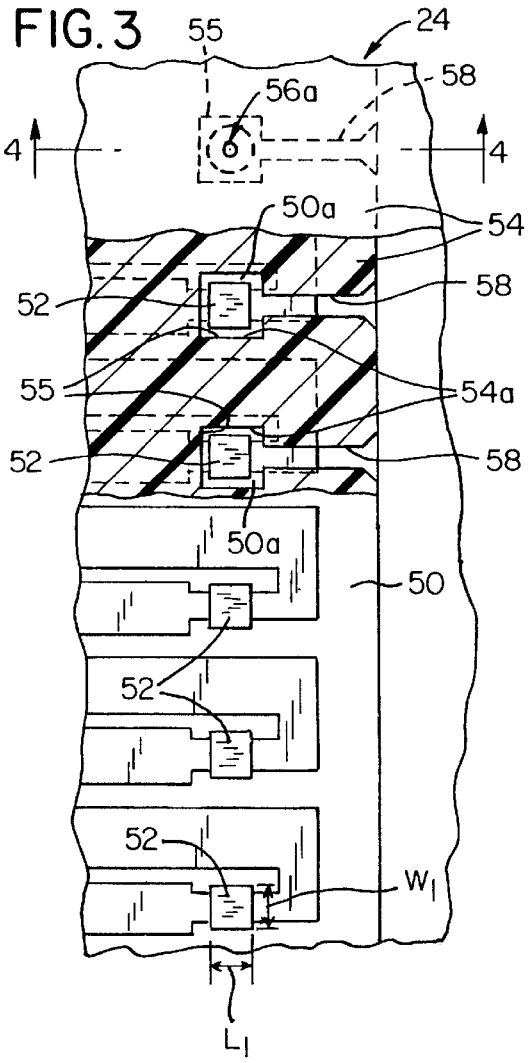
FIG. 3 is a plan view of a portion of a first printhead showing an outer surface of a section of the first plate, another section of the first plate having a portion partially removed, and the surface of a portion the first heating chip with the section of the first plate above that chip portion completely removed.
Figure 4:
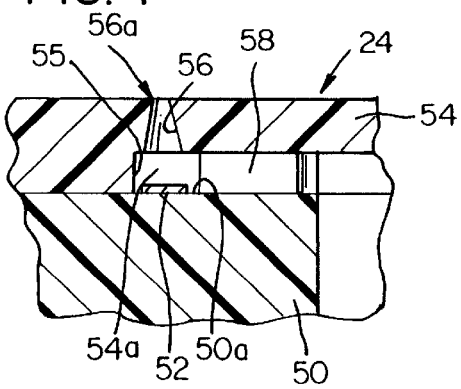
FIG. 4 is a view taken along view line 4—4 in FIG. 3.

The first print cartridge 20 comprises a first reservoir 22, see FIG. 2, filled with ink and a first printhead, see FIGS. 3 and 4, which is adhesively or otherwise joined to the reservoir 22. The second print cartridge 30 comprises a second reservoir 32 filled with ink and a second printhead 34, see FIGS. 2 and 5. The first and second reservoirs 22 and 32 preferably comprise polymeric containers. The reservoirs 22 and 32 may be refilled with ink.

The first printhead 24 comprises a first heater chip 50 having a plurality of first resistive heating elements 52. The first printhead 24 further includes a first plate 54 having a plurality of first openings 56 extending through it which define a plurality of first orifices 56*a* through which first droplets of a first size are ejected. In the illustrated embodiment, the first droplets are black.

The first plate 54 may be bonded to the first chip 50 via any art recognized technique, including a thermocompression bonding process. When the first plate 54 and the heater chip 50 are joined together, sections 54*a* of the first plate 54 and portions 50*a* of the first heater chip 50 define a plurality of first bubble chambers 55. Ink supplied by the reservoir 22 flows into the bubble chambers 55 through ink supply channels 58. The first resistive heating elements 52 are positioned on the heater chip 50 such that each bubble chamber 55 has only one first heating element 52. Each bubble chamber 55 communicates with one first orifice 56*a*, see FIG. 4.

The second printhead 34 comprises a second heater chip 60 having a plurality of second resistive heating elements 62. The second printhead 34 further includes a second plate 64 having a plurality of second openings 66 extending through it which define a plurality of second orifices 66*a*. In the illustrated embodiment, second color droplets of either cyan, magenta or yellow ink are ejected through the second orifices 66*a*. The second droplets have a second size which is less than first size of the first droplets.

The second plate 64 may be bonded to the second chip 60 in the same manner that the first plate 54 is bonded to the first chip 50. When the second plate 64 and the heater chip 60 are joined together, sections 64*a* of the second plate 64 and portions 60*a* of the second heater chip 60 define a plurality of second bubble chambers 65, see FIG. 5. The cyan, magenta and yellow inks supplied by the reservoir 22, which has separate ink-filled chambers (not shown), flow into the bubble chambers 65 through ink supply channels 68. Each bubble chamber 65 is provided with a single heating element 62 and communicates with a single second orifice 66*a*.

As will be discussed further below, the first and second resistive heating elements 52 and 62 are individually addressed by voltage pulses provided by a driver circuit 70. Each voltage pulse is applied to one of the heating elements 52 and 62 to momentarily vaporize the ink in contact with that heating element to form a bubble within the bubble chamber in which the heating element is located. The function of the bubble is to displace ink within the bubble chamber such that a droplet of ink is expelled from an orifice associated with the bubble chamber.

Figure 6:
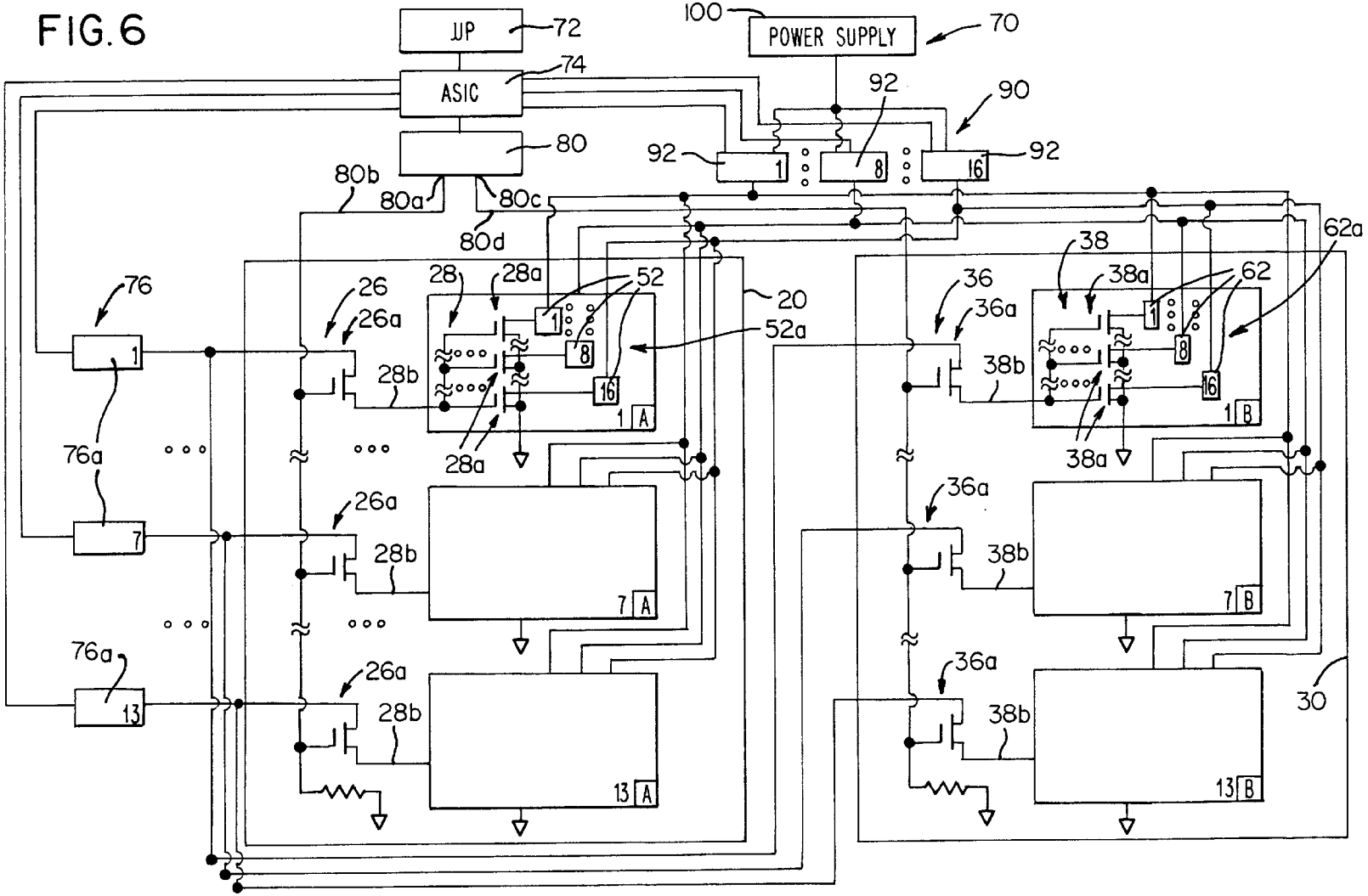
FIG. 6 is a schematic diagram illustrating the driver circuit of the present invention.

The first print cartridge 20 further comprises a first print cartridge enable circuit 26, see FIG. 6. In the illustrated embodiment, the first enable circuit 26 comprises thirteen first field effect transistors (FETs) 26*a*. Likewise, the second print cartridge 30 further comprises a second print cartridge enable circuit 36 which comprises thirteen second field effect transistors 36*a*.

The driver circuit 70 comprises a microprocessor 72, an application specific integrated circuit (ASIC) 74, a print cartridge select circuit 80 and a common drive circuit 90.

The print cartridge select circuit 80 selectively enables one of the first print cartridge 20 and the second print cartridge 30. It has a first output 80*a* which is electrically coupled to the gates of the first FETs 26*a* via conductor 80*b*. It also has a second output 80*c* which is electrically coupled to the gates of the second FETs 36*a* via a conductor 80*d*. Thus, a first print cartridge select signal present at the first output 80*a* is used to select the operation of the first cartridge 20 while a second print cartridge select signal present at the second output 80*c* is used to select the operation of the second cartridge 30. The print cartridge select circuit 80 is electrically coupled to the ASIC 74 and generates appropriate print cartridge select signals in response to command signals received from the ASIC 74.

The plurality of first resistive heating elements 52 are divided into groups. In the illustrated embodiment, thirteen first groups 52*a*, each having sixteen first heating elements 52, are provided. The plurality of second resistive heating elements 62 are similarly divided into thirteen second groups 62*a*, each having sixteen second heating elements 62.

The common drive circuit 90 comprises a plurality of drivers 92 which are electrically coupled to a power supply 100 and to the plurality of first and second resistive heating elements 52 and 62. In the illustrated embodiment, sixteen drivers 92 are provided. Each of the sixteen drivers 92 is electrically coupled to one of the sixteen first heating elements 52 in each of the thirteen first groups 52*a* and to one of the sixteen second heating elements 62 in each of the thirteen second groups 62*a*. Thus, each of the drivers 92 is coupled to thirteen first heating elements 52 and thirteen second heating elements 62.

The first print cartridge 20 further comprises a first heating element drive circuit 28 electrically coupled to the first heating elements 52 and the thirteen first field effect transistors (FETs) 26*a*. In the illustrated embodiment, the first heating element drive circuit 28 comprises thirteen groups of sixteen third field effect transistors (FETS) 28*a*. The FETs 28*a* in each of the thirteen groups are connected at their gates to the source of one of the thirteen first FETs 26*a* via conductors 28*b*, see FIG. 6. The drain of each of the third FETs 28*a* is electrically coupled to one of the first heating elements 52. The source of each of the third FETs 28*a* is connected to ground.

The second print cartridge 30 further comprises a second heating element drive circuit 38 electrically coupled to the second heating elements 62 and the thirteen second field effect transistors (FETs) 36*a*. In the illustrated embodiment, the second heating element drive circuit 38 comprises thirteen groups of sixteen fourth field effect transistors (FETs) 38*a*. The FETs 38*a* in each of the thirteen groups are connected at their gates to the source of one of the thirteen second FETs 36*a* via conductors 38*b*. The drain of each of the fourth FETs 38*a* is electrically coupled to one of the second heating elements 62. The source of each of the fourth FETs 38*a* is connected to ground.

The driver circuit 70 further comprises a resistive heating element group select circuit 76 comprising a plurality of select drivers 76*a*, thirteen in the illustrated embodiment. Each of the thirteen select drivers 76*a* is connected to the drain of one of the first FETs 26*a* and to the drain of one of the second FETs 36*a*. The ASIC 74 sequentially generates thirteen select signals to the thirteen select drivers 76*a*. Thus, in the illustrated embodiment, only a single select driver 76*a* is activated at any given time.

During a given firing period, only one group 52*a* of the first heating elements 52 or one group 62*a* of the second heating elements 62 will be enabled at any given time. The specific group that is enabled depends upon which select driver 76*a* has been activated by the ASIC 74 and which print cartridge has been enabled by the print cartridge select circuit 80. Any number, i.e., 0 to 16, of the sixteen heating elements within the selected group may be fired. The specific number fired depends upon print data received by the microprocessor 72 from a separate processor (not shown) electrically coupled to it. The microprocessor 72 generates signals to the ASIC 74 which, in turn, generates appropriate firing signals to the sixteen drivers 92. The activated drivers 92 then apply voltage pulses to the heating elements to which they are coupled. The voltage pulses applied to the first heating elements 52 have substantially the same amplitude and pulse width as those applied to the second heating elements 62.

In the illustrated embodiment, the first heating elements 52 have a generally square shape. They may, however, have a rectangular or other geometric shape. Preferably, the first heating elements have a first longitudinal dimension or length $L_1$ and a first transverse dimension or width $W_1$, see FIG. 3, where a ratio of these dimensions $L_1$ and $W_1$ is from about 0.8:1 to about 1.2:1.

Figure 5:
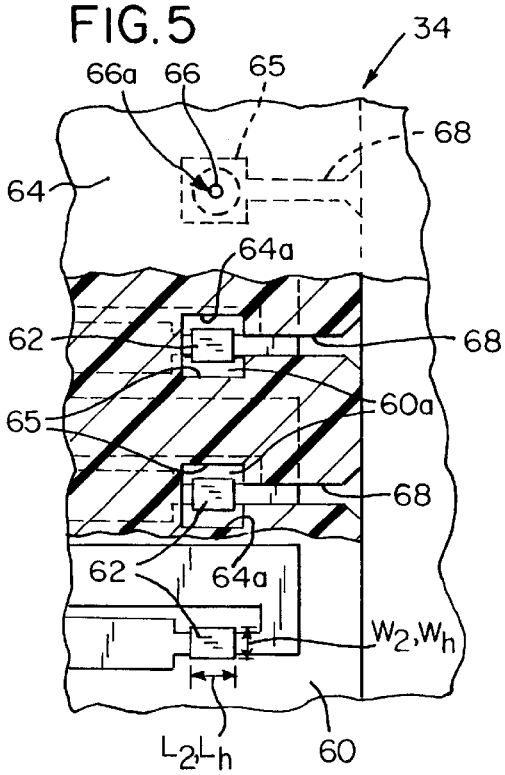
FIG. 5 is a plan view, partially broken away at two different depths, of a portion of a second printhead.

The second heating elements 62 have a generally rectangular shape, see FIG. 5. Preferably, a ratio of a second longitudinal dimension or length $L_2$ of the second heating elements 62 to a second transverse dimension or width $W_2$ of the second heating elements 62 is greater than or equal to about 1.2:1.0. Most preferably, the ratio of $L_2$ to $W_2$ is greater than or equal to about 1.5:1.0. The second heating elements 62 also have a second surface area which is less than the surface area of the first heating elements 52. Preferably, a ratio of the second surface area of the second heating elements 62 to the first surface area of the first heating elements 52 is about 0.4 to about 0.8 Because the surface area of the second heating elements 62 is less than the surface area of the first heating elements 52, the second printhead 34 ejects droplets which are smaller than those ejected by the first printhead 24.

The sheet resistance (Ω/square) of the material layer sections forming the first and second heating elements 52 and 62 is substantially the same. However, because the length/width ratio ($L_2/W_2$) of the second heating elements 62 is greater than that of the first heating elements 52, the resistance of the second heating elements 62 is greater than that of the first heating elements 52. This is because:

$$\text{Resistance}=\text{Sheet Resistance}\times(\text{Length}/\text{Width})$$

As noted above, the first and second heating elements 52 and 62 receive substantially identical voltage pulses, i.e., voltage pulses having the same duration and amplitude. Since the resistance of the second heating elements 62 is greater than that of the first heating elements 52, the second heating elements 62 absorb energy at a rate which is less than that of the first heating elements 52. Further, the second heating elements 62 absorb energy at a rate which is less than that of a conventional square heating element having substantially the same surface area but a lower resistance. Accordingly, the surface temperature of the second heating elements 62 will increase at a rate which is less than that of a conventional square heating element having the same surface area but a lower resistance. Preferably, a ratio of the resistance of the second heating elements 62 to the resistance of the first heating elements 52 is greater than or equal to about 1.2:1.0, and most preferably greater than or equal to about 1.5:1.0. More preferably, the resistance of the second heating elements 62 is selected such that the maximum surface temperature of the second heating elements 62 does not exceed about 700° C. during firing. Most preferably, the resistance of the second heating elements 62 is selected such that the surface temperature-time curve for the second heating elements 62 substantially follows that of the first heating elements 52.

An equation will now be derived which may be used in determining an appropriate second heating element size once a first heating element size has been determined.

The design constraints to be achieved are defined as follows:

1) color or second droplet spot size on paper approximately equal to black or first droplet spot size;
2) color or second print cartridge driving voltage amplitude equal to black or first print cartridge driving voltage amplitude;
3) color firing pulse width approximately equal to black firing pulse width;
4) color heating element energy density approximately equal to black heating element energy density;
5) color heating element surface temperature-time curve approximately equal to black heating element surface temperature-time curve;
6) color heating element sheet resistance equal to black heating element sheet resistance; and
7) color and black heating element maximum surface temperatures below about 700° C.

$$V_s-V_d=i(R_e+R_h) \tag{1}$$

where:

$V_s$ is the voltage from the power supply;

$V_d$ is the voltage drop across a driver 92;

i is current passing through a heating element;

$R_e$ is external resistances beyond the heating element, e.g., resistances of cables, wiring, etc.; and $R_h$ is the resistance of the heating element.

$$R_h=R_s(L_h/W_h)$$

where:

$R_s$ is sheet resistance;

$L_h$ is the length of the heating element; and $W_h$ is the width of the heating element.

$$\text{Energy Density } (ED) = \frac{i^2 R_h tp}{L_h W_h} = \frac{i^2 R_s tp}{L_h W_h}\left(\frac{L_h}{W_h}\right) = \frac{i^2 R_s tp}{W_h^2}$$

where:

tp is the pulse width of the voltage pulses

Solving for current:

$$i = W_h\sqrt{\frac{ED}{R_s tp}} \tag{2}$$

Substituting (2) into (1) and solving for $L_h$:

$$L_h = (V_s - V_d)\sqrt{\frac{tp}{(ED)(R_s)}} - \left(\frac{R_e}{R_s}\right)(W_h) \tag{3}$$

Initially, a first or black printhead 24 is designed in a conventional manner. From that design, values for the following variables are fixed:

$V_s$, $V_d$, tp, $R_s$, ED, $R_e$

When these values are inserted into equation (3), an expression is provided for heater length as a function of heater width. That expression will be referred to hereafter as the final equation.

Assuming that the maximum surface temperature of the black heating elements is below about 700° C., the final equation satisfies design constraints 2–8.

The final step is to find the appropriate second heating element length and width such that the appropriate color or second droplet spot size is achieved. This step involves arbitrarily selecting a number of possible heating element widths and then solving for the corresponding heating element lengths using the final equation. Testing of second heating elements having those widths and lengths is then required to determine which one produces a spot size which satisfies constraint 1.

The following example is being provided for illustrative purposes only and is not intended to be limiting. First and second printheads having first and second heating elements were constructed. The first heating elements had a length $L_h$ equal to 32.5 μm and a width $W_h$ equal to 32.5 μm. The second heating elements had a length $L_h$ equal to 36 μm and a width $W_h$ equal to 18 μm. The resistance of the first heating elements was 28.2 Ω and the resistance of the second heating elements was 56.6 Ω.

When voltage pulses having an amplitude of 11.6 V and a duration of 1.5 μs were applied to the first heating elements, 322 mA of current passed through them. Further, they had an energy density of about 4164 J/m$^2$ and a power density of 2.8 GW/m$^2$. The energy absorbed by the first heating elements was approximately 4.4 μJ. When voltage pulses of the same duration and amplitude were applied to the second heating elements, 179 mA of current passed through them. Further, they had an energy density of about 4165 J/m$^2$ and a power density of 2.8 GW/m$^2$. The energy absorbed by the second heating elements was approximately 2.7 μJ. Because the voltage pulses applied to the first and second heating elements were of the same duration and amplitude and because energy density was essentially constant, the surface temperature-time curve for the second heating elements was essentially the same as that of the first heating elements. Further, because the second heating elements had a smaller surface area than the first heating elements, they resulted in smaller droplets being ejected by the second print cartridge. The maximum surface temperature for both the first and second heating elements was below about 700° C.

It is further contemplated that split voltage pulses may be provided to the first and second heating elements. A driver circuit for providing split voltage pulses is disclosed in concurrently filed patent application, U.S. Ser. No. 08/823,594, entitled "Ink Jet Printer Having Driver Circuit for Generating Warming and Firing Pulses for Heating Elements," by Robert W. Cornell et al., which is hereby incorporated by reference herein.

What is claimed is:

1. An inkjet printing apparatus comprising:

a first print cartridge including a first resistive heating element in a first ink-containing chamber having a first orifice, said first heating element having first longitudinal and transverse dimensions and a first resistance, a ratio of said first longitudinal dimension to said first transverse dimension is from about 0.8:1.0 to about 1.2:1.0;

a second print cartridge including a second resistive heating element in a second ink-containing chamber having a second orifice, said second heating element having second longitudinal and transverse dimensions and a second resistance, a ratio of said second longitudinal dimension to said second transverse dimension being greater than or equal to about 1.5:1.0, wherein a ratio of said second resistance to said first resistance is greater than or equal to 1.2:1; and a driver circuit, electrically coupled to said first and second print cartridges, for selectively applying to one of said first and second heating elements a firing pulse, said firing pulse to said first heating element causing a vapor bubble to be produced in said first chamber such that a droplet of ink of a first size is ejected from said first chamber orifice and said firing pulse to said second heating element causing a vapor bubble to be produced in said second chamber such that a droplet of ink of a second size which is smaller than said first size is ejected from said second chamber orifice.

2. An ink jet printing apparatus as set forth in claim 1, wherein said first and second heating elements comprise layer material sections having substantially equivalent sheet resistances.

3. An ink jet printing apparatus as set forth in claim 1, wherein a ratio of the second resistance of said second heating element to the first resistance of said first heating element is greater than or equal to about 1.2:1.

4. An ink jet printing apparatus as set forth in claim 3, wherein said first heating element has a first surface area, said second heating element has a second surface area, and a ratio of said second surface area to said first surface area is from about 0.4 to about 0.8.

5. An ink jet printing apparatus as set forth in claim 1, wherein said first resistive heating element is substantially square.

6. An ink jet printing apparatus as set forth in claim 5, wherein said second resistive heating element is substantially rectangular.

7. An ink jet printing apparatus as set forth in claim 1, wherein said first print cartridge includes a plurality of first resistive heating elements and a plurality of first ink-containing chambers, said second print cartridge includes a plurality of second resistive heating elements and a plurality of second ink-containing chambers, and wherein each of said first ink-containing chambers has a first substantially circular orifice and each of said second ink-containing chambers has a second substantially circular orifice.

8. An ink jet printing apparatus as set forth in claim 7, wherein said first print cartridge comprises:

a first plate having a plurality of first openings formed therein which define said first orifices; and a first heater chip having said plurality of first resistive heating elements formed thereon, said first plate being coupled to said first heater chip such that sections of said first plate and portions of said first heater chip define said plurality of first ink-containing chambers, and said plurality of first resistive heating elements are positioned on said first heater chip such that each of said first ink-containing chambers has one of said first heating elements located therein.

9. An ink jet printing apparatus as set forth in claim 8, wherein said second print cartridge comprises:

a second plate having a plurality of second openings formed therein; and a second heater chip having said plurality of second resistive heating elements formed thereon, said second plate being coupled to said second heater chip such that sections of said second plate and portions of said second heater chip define said plurality of second ink-containing chambers, and said plurality of second resistive heating elements are positioned on said second heater chip such that each of said second ink-containing chambers has one of said second heating elements located therein.

10. An ink jet printing apparatus as set forth in claim 7, wherein said first print cartridge enable circuit comprises at least one transistor and said second print cartridge enable circuit comprises at least one transistor.

11. An ink jet printing apparatus as set forth in claim 7, wherein said driver circuit comprises:

a print cartridge select circuit electrically coupled to said first print cartridge enable circuit and said second print cartridge enable circuit for selectively enabling one of said first print cartridge and said second print cartridge; and a common drive circuit electrically coupled to said plurality of first resistive heating elements and said plurality of second resistive heating elements.

12. An ink jet printing apparatus as set forth in claim 11, wherein:

said plurality of first resistive heating elements are divided into at least two groups of first resistive heating elements and said first print cartridge further comprises a first heating element drive circuit electrically coupled to said plurality of first heating elements and said first print cartridge enable circuit;

said plurality of second resistive heating elements are divided into at least two groups of second resistive heating elements and said second print cartridge further comprises a second heating element drive circuit electrically coupled to said plurality of second heating elements and said second print cartridge enable circuit; and said driver circuit further comprises a resistive heating element group select circuit electrically coupled to said first and second print cartridge enable circuits which in turn are electrically coupled to said first and second heating element drive circuits, said resistive heating element group select circuit selecting one of said at least two groups of said first heating elements and one of said two groups of said second heating elements.

13. An ink jet printing apparatus as set forth in claim 1, wherein said first print cartridge further comprises a first reservoir filled with ink and said second print cartridge further comprises a second reservoir filled with ink.

14. An ink jet printing apparatus as set forth in claim 13, wherein said first and second reservoirs are refillable with ink.

15. An ink jet printing apparatus comprising:

a first print cartridge including a first substantially square resistive heating element in a first ink-containing chamber having a first orifice, said first heating element having a first resistance, a first surface area, and having first longitudinal and transverse dimensions, wherein a ratio of said first longitudinal and transverse dimensions is from about 0.8 to about 1.2:1.0, said first print cartridge further including a first print cartridge enable circuit;

a second print cartridge including a second substantially rectangular resistive heating element in a second ink-containing chamber having a second orifice, said second heating element having a second resistance, a second surface area, and having second longitudinal and transverse dimensions, wherein a ratio of said second longitudinal and transverse dimensions is greater than or equal to about 1.5:1.0, and a ratio of said second resistance to said first resistance is greater than or equal to about 1.2:1, said second print cartridge further including a second print cartridge enable circuit; and a driver circuit, electrically coupled to said first and second printing cartridges, for selectively applying to one of said first and second heating elements a firing pulse, said firing pulse to said first heating element causing a vapor bubble to be produced in said first chamber such that a droplet of ink of a first size is ejected from said first chamber orifice and said firing pulse to said second heating element causing a vapor bubble to be produced in said second chamber such that a droplet of ink of a second size which is smaller than said first size is ejected from said second chamber orifice.

16. An ink jet printing apparatus as set forth in claim 15, wherein said first and second heating elements comprise layer material sections having substantially equivalent sheet resistances.

17. An ink jet printing apparatus as set forth in claim 15, wherein a ratio of the surface area of said second heating element to the surface area of said first heating element is from about 0.4 to about 0.8.

18. An ink jet printing apparatus as set forth in claim 15, wherein said first resistive heating element is essentially square in shape.

19. An ink jet printing apparatus as set forth in claim 18, wherein said second resistive heating element is essentially rectangular in shape.

20. An ink jet printing apparatus as set forth in claim 15, wherein said first print cartridge includes a plurality of first resistive heating elements and a plurality of first ink-containing chambers, said second print cartridge includes a plurality of second resistive heating elements and a plurality of second ink-containing chambers, and wherein each of said first ink-containing chambers has a first orifice and each of said second ink-containing chambers has a second orifice.

21. An ink jet printing apparatus as set forth in claim 20, wherein said first print cartridge enable circuit comprises at least one transistor and said second print cartridge enable circuit comprising at least one transistor.

22. An ink jet printing apparatus as set forth in claim 20 wherein said driver comprises:

a print cartridge select circuit electrically coupled to said first print cartridge enable circuit and said second print cartridge enable circuit for selectively enabling one of said first print cartridge and said second print cartridge; and a common drive circuit electrically coupled to said plurality of first resistive heating elements and said plurality of second resistive heating elements.

23. An ink jet printing apparatus as set forth in claim 22, wherein:

said plurality of first resistive heating elements are divided into at least two groups of first resistive heating elements and said first print cartridge further comprises a first heating element drive circuit electrically coupled to said plurality of first heating elements and said first print cartridge enable circuit;

said plurality of second resistive heating elements are divided into at least two groups of second resistive heating elements and said second print cartridge further comprises a second heating element drive circuit electrically coupled to said plurality of second heating elements and said second print cartridge enable circuit; and said driver circuit further comprises a resistive heating element group select circuit electrically coupled to said first and second print cartridge enable circuits which in turn are electrically coupled to said first and second heating element drive circuits, said resistive heating element group select circuit selecting one of said at least two groups of said first heating elements and one of said two groups of said second heating elements.

24. An ink jet printing apparatus comprising:

a first print cartridge including a first substantially square resistive heating element in a first ink-containing chamber having a first orifice, said first heating element having a first surface area, and first longitudinal and transverse dimensions, wherein a ratio of said first longitudinal and transverse dimensions is from about 0.8 to about 1.2:1.0, said first print cartridge further including a first print cartridge enable circuit;

a second print cartridge including a second substantially rectangular resistive heating element in a second ink-containing chamber having a second orifice, said second heating element having a second surface area, and second longitudinal and transverse dimensions, wherein a ratio of said second longitudinal and transverse dimensions is greater than or equal to about 1.5:1.0, and wherein said second surface area is less than said first surface area, said second print cartridge further including a second print cartridge enable circuit; and a driver circuit, electrically coupled to said first and second print cartridges, for selectively applying to one of said first and second heating elements by way of a common drive circuit a firing pulse, said firing pulse to said first heating element causing a vapor bubble to be produced in said first chamber such that a droplet of ink of a first size is ejected from said first chamber orifice and said firing pulse to said second heating element causing a vapor bubble to be produced in said second chamber such that a droplet of ink of a second size which is smaller than the first size is ejected from said second chamber orifice.

25. An ink jet printing apparatus as set forth in claim 24, wherein said second heating element has second longitudinal and transverse dimensions and a ratio of said second longitudinal dimension to said second transverse dimension is greater than or equal to about 1.2:1.0.

26. An ink jet printing apparatus as set forth in claim 24, wherein said first and second heating elements comprise layer material sections having substantially equivalent sheet resistances.

27. An ink jet printing apparatus as set forth in claim 24, wherein said first print cartridge includes a plurality of first resistive heating elements and a plurality of first ink-containing chambers, said second print cartridge includes a plurality of second resistive heating elements and a plurality of second ink-containing chambers, and wherein each of said first ink-containing chambers has a first orifice and each of said second ink-containing chambers has a second orifice.

28. An ink jet printing apparatus as set forth in claim 27, wherein said first print cartridge enable circuit comprises at least one transistor and said second print cartridge enable circuit comprises at least one transistor.

29. An ink jet printing apparatus as set forth in claim 27, wherein said driver circuit comprises:

a print cartridge select circuit electrically coupled to said first print cartridge enable circuit and said second print cartridge enable circuit for selectively enabling one of said first print cartridge and said second print cartridge; and said common drive circuit which is electrically coupled to said plurality of first resistive heating elements and said plurality of second resistive heating elements.

30. An ink jet printing apparatus as set forth in claim 29, wherein:

said plurality of first resistive heating elements are divided into at least two groups of first resistive heating elements and said first print cartridge further comprises a first heating element drive circuit electrically coupled to said plurality of first heating elements and said first print cartridge enable circuit;

said plurality of second resistive heating elements are divided into at least two groups of second resistive heating elements and said second print cartridge further comprises a second heating element drive circuit electrically coupled to said plurality of second heating elements and said second print cartridge enable circuit; and said driver circuit further comprises a resistive heating element group select circuit electrically coupled to said first and second print cartridge enable circuits which in turn are electrically coupled to said first and second heating element drive circuits, said resistive heating element group select circuit selecting one of said at least two groups of said first heating elements and one of said two groups of said second heating elements.

31. An inkjet printing apparatus comprising:

a first print cartridge including a first substantially square resistive heating element in a first ink-containing chamber having a first orifice, said first heating element having a first surface area, a first resistance, and first longitudinal and transverse dimensions, wherein a ratio of said first longitudinal and transverse dimensions is from about 0.8 to about 1.2:1.0, said first print cartridge further including a first print cartridge enable circuit;

a second print cartridge including a second substantially rectangular resistive heating element in a second ink-containing chamber having a second orifice, said second heating element having a second surface area, a second resistance and second longitudinal and transverse dimensions, wherein a ratio of said second longitudinal and transverse dimensions is greater than or equal to about 1.5:1.0, and wherein said second surface area is less than said first surface area, said second print cartridge further including a second print cartridge enable circuit; and a driver circuit, electrically coupled to said first and second print cartridges, for applying to said first and second heating elements by way of a common drive circuit voltage pulses of substantially equivalent duration, wherein heater energy density for said first heating element is substantially the same as heater energy density for said second heating element.

32. An ink jet printing apparatus as set forth in claim 31, wherein said voltage pulses have substantially equivalent amplitudes.

33. An ink jet printing apparatus as set forth in claim 31, wherein said first and second heating elements comprise layer material sections having substantially equivalent sheet resistances.

34. An ink jet printing apparatus as set forth in claim 31, wherein a ratio of the second resistance of said second heating element to the first resistance of said first heating element is greater than or equal to about 1.2:1.

* * * * *